US011737548B2

(12) United States Patent
Mueller

(10) Patent No.: US 11,737,548 B2
(45) Date of Patent: Aug. 29, 2023

(54) DEVICE FOR APPLYING A REMOVABLE SUBSTANCE IN THE FORM OF A STICK

(71) Applicant: RPC Bramlage GmbH, Lohne (DE)

(72) Inventor: Roger Mueller, Dinklage (DE)

(73) Assignee: RPC Bramlage GmbH, Lohne (DE)

( * ) Notice: Subject to any disclaimer, the term of this patent is extended or adjusted under 35 U.S.C. 154(b) by 226 days.

(21) Appl. No.: 17/439,925

(22) PCT Filed: Mar. 24, 2020

(86) PCT No.: PCT/EP2020/058057
§ 371 (c)(1),
(2) Date: Sep. 16, 2021

(87) PCT Pub. No.: WO2020/193497
PCT Pub. Date: Oct. 1, 2020

(65) Prior Publication Data

US 2022/0183444 A1 Jun. 16, 2022

(30) Foreign Application Priority Data

Mar. 27, 2019 (DE) ..... 10 2019 107 890.3

(51) Int. Cl.
*A45D 40/06* (2006.01)
*A45D 40/04* (2006.01)
(Continued)

(52) U.S. Cl.
CPC ..... *A45D 40/06* (2013.01); *A45D 40/04* (2013.01); *A45D 40/12* (2013.01); *A45D 2040/0025* (2013.01)

(58) Field of Classification Search
CPC ..... A45D 40/06; A45D 40/065; A45D 40/12; A45D 2040/0025
See application file for complete search history.

(56) References Cited

U.S. PATENT DOCUMENTS 5,984,552 A * 11/1999 Ackermann ..... A45D 40/06 401/74
6,623,198 B2 * 9/2003 Holloway ..... A45D 40/12 401/78
(Continued)

FOREIGN PATENT DOCUMENTS

DE 10 2016 116 134 A1 3/2018
EP 0 879 569 A1 11/1998
(Continued)

OTHER PUBLICATIONS

International Search Report of PCT/EP2020/058057, dated Jul. 9, 2020.

*Primary Examiner* — Jennifer C Chiang
(74) *Attorney, Agent, or Firm* — Collard & Roe, P.C.

(57) ABSTRACT

A device for applying a removable substance in the form of a baton, has a substance carrier and a protective sleeve so that the substance carrier can be made to move relative to the protective sleeve. A movement part has a longitudinal slot in which the substance carrier is guided by a peg, and the substance carrier can be moved between a retracted position and an extended position. The longitudinal slot has a retaining portion assigned to the extended position, the central longitudinal axis of which runs at an angle to a central longitudinal axis of a movement portion of the longitudinal slot. The central longitudinal axis of the retaining portion and the central longitudinal axis of the movement portion enclose an obtuse angle.

11 Claims, 20 Drawing Sheets

(51) Int. Cl.
*A45D 40/12* (2006.01)
*A45D 40/00* (2006.01)

(56) References Cited

U.S. PATENT DOCUMENTS

| | | | | |
|---|---|---|---|---|
| 7,325,991 | B2 * | 2/2008 | Holloway | A45D 40/06 401/78 |
| 9,474,349 | B2 | 10/2016 | Holloway | |
| 10,595,614 | B2 * | 3/2020 | Benigni | A45D 40/06 |
| 10,912,369 | B2 | 2/2021 | Presche | |

FOREIGN PATENT DOCUMENTS

| | | | |
|---|---|---|---|
| EP | 2 772 153 | A1 | 9/2014 |
| JP | H07-12018 | U | 2/1995 |

* cited by examiner

X
10
3
4
26
1
M
21
22
2
19
24
23
7
24
17
6'
15
17
6
8
14
16
5
13
13
11
12
X

DEVICE FOR APPLYING A REMOVABLE SUBSTANCE IN THE FORM OF A STICK

CROSS REFERENCE TO RELATED APPLICATIONS

This application is the National Stage of PCT/EP2020/058057 filed on Mar. 24, 2020, which claims priority under 35 U.S.C. § 119 of German Application No. 10 2019 107 890.3 filed on Mar. 27, 2019, the disclosure of which is incorporated by reference. The international application under PCT article 21(2) was not published in English.

TECHNICAL FIELD

The invention pertains to a device for applying a transferable substance in the form of a stick, comprising a substance carrier and a protective sleeve for the substance carrier, wherein the substance carrier can be displaced relative to the protective sleeve in order to displace a free end region of the substance into a freely projecting position, wherein a movement part furthermore is provided with a longitudinal slot, in which the substance carrier is guided with a peg engaging into the longitudinal slot, and the substance carrier can be moved between a retracted position and an extended position, wherein the longitudinal slot has a retaining portion assigned to the extended position, and wherein the central longitudinal axis of said retaining portion extends at an angle to a central longitudinal axis of a movement portion of the longitudinal slot.

PRIOR ART

Devices of the type in question are known, for example, in the form of sticks containing a substance that can be transferred, e.g. as a result of friction. Furthermore, such sticks are also known, for example, in the form of lipsticks, as well as in the form of sticks for applying body care products, particularly skin care products, or for applying medicinal products.

We refer, for example, to DE 10 2016 116 134 A1. It is known from this disclosure to guide a piston-like substance carrier in a movement part, which is realized in the form of a slotted sleeve, in such a way that a moving direction of the substance carrier in the direction of a longitudinal axis of the device can thereby be achieved. Assigned to an extended position of the substance carrier, the movement portion of the longitudinal slot, which essentially extends in the longitudinal direction of the device, transforms into a retaining portion, which essentially extends perpendicular to the movement portion. The peg of the substance carrier is guided in this retaining portion in the extended position, wherein the substance carrier can be prevented from moving in the direction of the longitudinal axis in this position.

EP 2 772 153 A1 discloses a device for applying a transferable substance in the form of a stick, in which the control groove in a counter-retaining cylinder tapers off into a funnel-shaped widening on the same surface level as that of a groove bottom of the control groove. JPH 0 712 018 U discloses a device for applying a transferable substance, in which vertically extending rail-like friction cams are provided.

SUMMARY OF THE INVENTION

Based on the prior art according to EP 2 772 153 A1, the invention aims to disclose a device of this type, which allows an advantageous interaction between the counter-retaining cylinder and the peg with respect to a control groove.

Based on the last-mentioned prior art, the invention aims to disclose an advantageous design of the friction cams in a device of this type.

The initially cited objective is attained with a device, in which it is proposed that the substance carrier is accommodated in a counter-retaining cylinder, in the inner wall of which a control groove for the peg is formed, and that the control groove has assigned to the extended position an inclined surface that leads to the transition to the cylindrical inner surface of the counter-retaining cylinder, wherein the peg is not or only partially in overlap with the inclined surface in the extended position.

The other objective is attained with the object of a device in which it is proposed that, in a view of an outer edge of the friction cam from radially outside, the greatest dimension in the transverse direction is realized eccentric to the greatest dimension in the longitudinal direction, and that the outer edge of the friction cam has a drop-shaped contour.

The device has an advantageous design, particularly in terms of handling. The displacement of the substance carrier from the retracted position in the direction of the extended position, which takes place as a result of user intervention, is simplified with respect to the transition of the peg guide from the movement portion extending linearly in the axial direction to the retaining portion.

The substance carrier is accommodated in a counter-retaining cylinder, in the inner wall of which a control groove for the peg is formed, and the control groove has assigned to the extended position an inclined surface that leads to the transition to the cylindrical inner surface of the counter-retaining cylinder, wherein the peg is not or only partially in overlap with the inclined surface in the extended position.

An optionally continuous, but in any case non-stepped transition of the control groove to the cylindrical inner surface of the counter-retaining cylinder is achieved as a result of the formation of the inclined surface of the control groove. This may prove advantageous with respect to the assembly, particularly the installation of the piston. This design furthermore may prove advantageous with respect to a potential removal of the counter-retaining cylinder from a mould during its manufacture, e.g. in a plastic injection moulding process.

An advantageous interaction between the peg and the control groove is also achieved if the peg only overlaps the inclined surface partially in the extended position. In the extended position, in particular, this makes it possible to counteract chip formation, particularly in the region of the peg of the substance carrier. This may prove particularly advantageous if the entire device or at least the substance carrier and the counter-retaining cylinder are manufactured homogenously and accordingly of the same material as proposed in a potential embodiment.

It is furthermore preferred that the retaining portion provides an extension limit stop for the substance carrier such that this substance carrier preferably is retained in the movement part in a captive manner.

It is furthermore preferred that the substance carrier can be prevented from moving upon the engagement of the peg of the substance carrier into the retaining portion. In the direction of the extended position, this movement prevention preferably is realized by means of a stop. In the direction of the retracted position, the movement prevention optionally may be realized upon the engagement of the peg into the retaining portion solely due to the preferred obtuse angle between the central axes of the movement portion and the retaining portion.

The transition of the peg displacement from the movement portion to the retaining portion is facilitated and simplified due to the obtusely angled arrangement and furthermore preferably requires less effort than solutions known from the prior art.

The dimension of the obtuse angle may lie between 100 and 170 degrees, furthermore between approximately 110 and 130 degrees, e.g. between approximately 115 and 120 degrees.

The friction cams are designed non-circular with a longer and a shorter dimension, wherein the longer dimension essentially is realized in the direction of the movement portion. The shorter dimension may be realized in the circumferential direction of the substance carrier. Furthermore, the longer dimension of the friction cam may extend in the normal displacement direction of the substance carrier.

In a view of an outer edge of the friction cam from radially outside, the greatest dimension in the transverse direction, i.e. the greatest dimension of the above-described transversely directed shorter dimension, may in another embodiment be realized eccentric to the greatest dimension in the longitudinal direction. In a standing position of the device, in which its longitudinal axis preferably is essentially oriented vertically and the opening for displacing the substance outward in a sliding manner is directed upward, the greatest dimension in the transverse direction may be realized underneath a center of the greatest dimension in the longitudinal direction of the catch projection.

In another embodiment, the outer edge of the friction cam may altogether have an approximately drop-shaped contour with respect to a view from radially outside. With respect to a standing position of the above-described type, a narrow and pointed end region may be directed upward and a comparatively obtuse and wider drop arc may be directed downward.

The abrasion tendency is reduced, in particular, due to the above-described design of such a friction cam, in which a desired increase in the friction of the substance carrier relative to the movement part is realized and the substance carrier is guided such that it is prevented from tilting.

The arrangement of friction cams on the substance carrier makes it possible to realize self-locking of the substance carrier, particularly in an intermediate position between the retracted position and the extended position, especially in an intermediate position, in which the peg of the substance carrier engages into the movement portion, which essentially extends in alignment with the longitudinal axis of the device.

In this case, the friction cams may be realized in such a way that self-locking of the substance carrier can be achieved up to a load of 6 g or more, e.g. up to 8 or 10 g.

The friction cams may be realized integrally and/or uniformly in material with the substance carrier in the form of projections that protrude outward relative to an otherwise circumferential and preferably cylindrical substance carrier wall.

Multiple friction cams of this type may be provided on the circumference of the substance carrier with respect to a displacement axis of the substance carrier, which preferably can correspond to the alignment of a longitudinal axis of the device. Furthermore, these friction cams may be distributed over the circumference uniformly, but alternatively also non-uniformly.

The friction cams furthermore can serve for improving the haptics during the use of the device. In addition, the arrangement of the friction cams can improve the guidance of the substance carrier in the movement part altogether, particularly by preventing the substance carrier from tilting in the movement part due to the support of the friction cams on the inner surface of the movement part.

In this context, it would be possible that at least the substance carrier and the counter-retaining cylinder, but preferably also the movement part and optionally an additionally provided closing cap, are manufactured homogenously of only one plastic material, particularly in a plastic injection moulding process. In this respect, polypropylene (PP) may be used as plastic material.

According to another embodiment, the retaining portion of the longitudinal slot in the movement part may have a catch projection, which can be overrun by the peg of the substance carrier and serves for retaining the substance carrier, particularly in the extended position.

It is furthermore preferred that the catch projection can be overrun for the entry of the peg into the retaining portion, as well as in the course of a return displacement of the peg from the retaining portion in the direction of the movement portion. A haptic feedback for the user is thereby realized as the peg enters the retaining portion and overruns the catch projection. This overrunning of the catch projection, as well as the overrunning of the catch projection for the displacement of the substance carrier from the extended position in the direction of the retracted position, requires a greater effort than the normal displacement of the peg along the movement portion, which preferably extends linearly in the axial direction. However, the greater effort for overcoming the catch projection lies within the normal effort range for actuating a device of the type in question.

The design of the catch projection in the region of the retaining portion assigned to the extended position particularly may result in an advantageous extension end position, which is only reversible by overcoming a retaining force. This can lead to an advantageous operation of the device. A normal pressure upon the substance, which in the extended position projects freely beyond the counter-retaining cylinder and preferably also beyond the movement part, can be absorbed by the overrunnable catch retention in the region of the retaining portion.

Furthermore, advantages with respect to filling the substance carrier with substance may thereby be achieved. Such a filling process may take place in the uppermost position, namely in the above-described extended position, wherein the substance carrier optionally has to withstand a pressure, e.g., of up to 20 Newton in the direction of a displacement of the substance carrier from the extended position in the direction of the retracted position.

According to another potential embodiment, two opposing longitudinal slots may also be formed on the movement part. In a potential circular-cylindrical design of the movement part, the longitudinal slots may be provided diametrically opposite of one another with respect to a plane that is aligned transverse to the longitudinal axis of the movement part.

In this case, each longitudinal slot furthermore may serve for receiving a peg of the substance carrier. Accordingly, two opposing pegs may be provided on the substance carrier in an embodiment with two opposing longitudinal slots.

If the movement part is designed with two longitudinal slots, both longitudinal slots may have an overrunnable catch projection in the respective retaining portion. The catch projections of both retaining portions may be designed identically in this case.

An additional retaining portion may also be provided with respect to the retracted position of the substance carrier, wherein a central axis of this retaining portion and the central axis of the movement portion of the longitudinal slot may also include an obtuse angle, e.g., of 100 to 170 degrees, furthermore between 110 and 130 degrees.

With respect to a potential retaining portion that is assigned to the retracted position of the substance carrier, it would furthermore also be possible to provide a catch projection, which can be overrun in both directions and is realized similar or identical to the catch projection in the retaining portion assigned to the extended position, such that the user practically can also sense when the retracted position is reached. Overrunning of the catch projection requires a greater effort than the normal linear displacement of the substance carrier in the movement portion.

The maximally retracted position preferably is reached by overrunning the optionally provided catch projection in the retaining portion assigned to the retracted position. This maximally retracted position can lead to damages of the device parts, particularly the pegs of the substance carrier, as a result of a further rotational displacement of the movement part relative to the counter-retaining cylinder. In this context, it is therefore advantageously proposed to realize the maximally retracted position of the substance carrier in such a way that it can be overrun. According to a preferred embodiment, the control groove in the counter-retaining cylinder may to this end be tapered off open at the edges on the bottom side, i.e. in the retaining portion of the movement part assigned to the retracted position. During a further rotational displacement of the movement part relative to the counter-retaining cylinder, the pegs of the substance carrier therefore may carry out an excursion radially inward such that the pegs are respectively pushed out of the control groove or the control grooves of the counter-retaining cylinder during the further displacement along the assigned longitudinal slot, particularly the corresponding retaining portion, in order to subsequently brush along the preferably circular-cylindrical inner wall of the counter-retaining cylinder as a result of the further rotational displacement until they once again penetrate into the next control groove in the circumferential direction.

In this case, the user is also haptically informed of the overrunnable end position in the retracted position. Damages to the device parts are therefore counteracted.

The maximally extended position of the substance carrier, in contrast, preferably can be designed such that it cannot be overrun. In this maximally extended position, the respective peg of the substance carrier may be captured between step-like outer edge regions of the retaining portion of the movement part and the control groove of the counter-retaining cylinder.

A control groove may be formed in the counter-retaining cylinder for each peg. In a preferred embodiment of the substance carrier with two diametrically opposed pegs, the inner wall of the counter-retaining cylinder accordingly may be provided with two control grooves, which optionally engage into one another in a screw thread-like manner.

In this case, the control grooves in the counter-retaining cylinder may be designed in such a way that the movement part can be rotated relative to the counter-retaining cylinder by two to three revolutions, e.g. 2.5 revolutions, but also by less than two revolutions, e.g. 0.5 to 1 revolutions, particularly 0.75 revolutions, between a maximally retracted position and a maximally extended position.

In this case, both control grooves may have an inclined surface of the above-described type assigned to the extended position.

With respect to the disclosure, the ranges or value ranges or multiple ranges indicated above and below also include all intermediate values, particularly in 1/10 increments of the respective dimension, but optionally also dimensionless. For example, the indication of 100 to 170 degrees also includes the disclosure of 100.1 to 170 degrees, 100 to 169.9 degrees, 100.1 to 169.9 degrees, etc. The respective disclosure may on the one hand serve for defining a lower and/or upper limit of a cited range, but alternatively or additionally also for disclosing one or more singular values from a respectively indicated range.

BRIEF DESCRIPTION OF THE DRAWINGS

The invention is described in greater detail below with reference to the attached drawings, which merely show an exemplary embodiment. In these drawings.

DESCRIPTION OF THE EMBODIMENTS

A device 1 for applying a transferable substance M in the form of a stick is initially described with reference to the illustrations in FIGS. 1 and 2.

Figure 2:
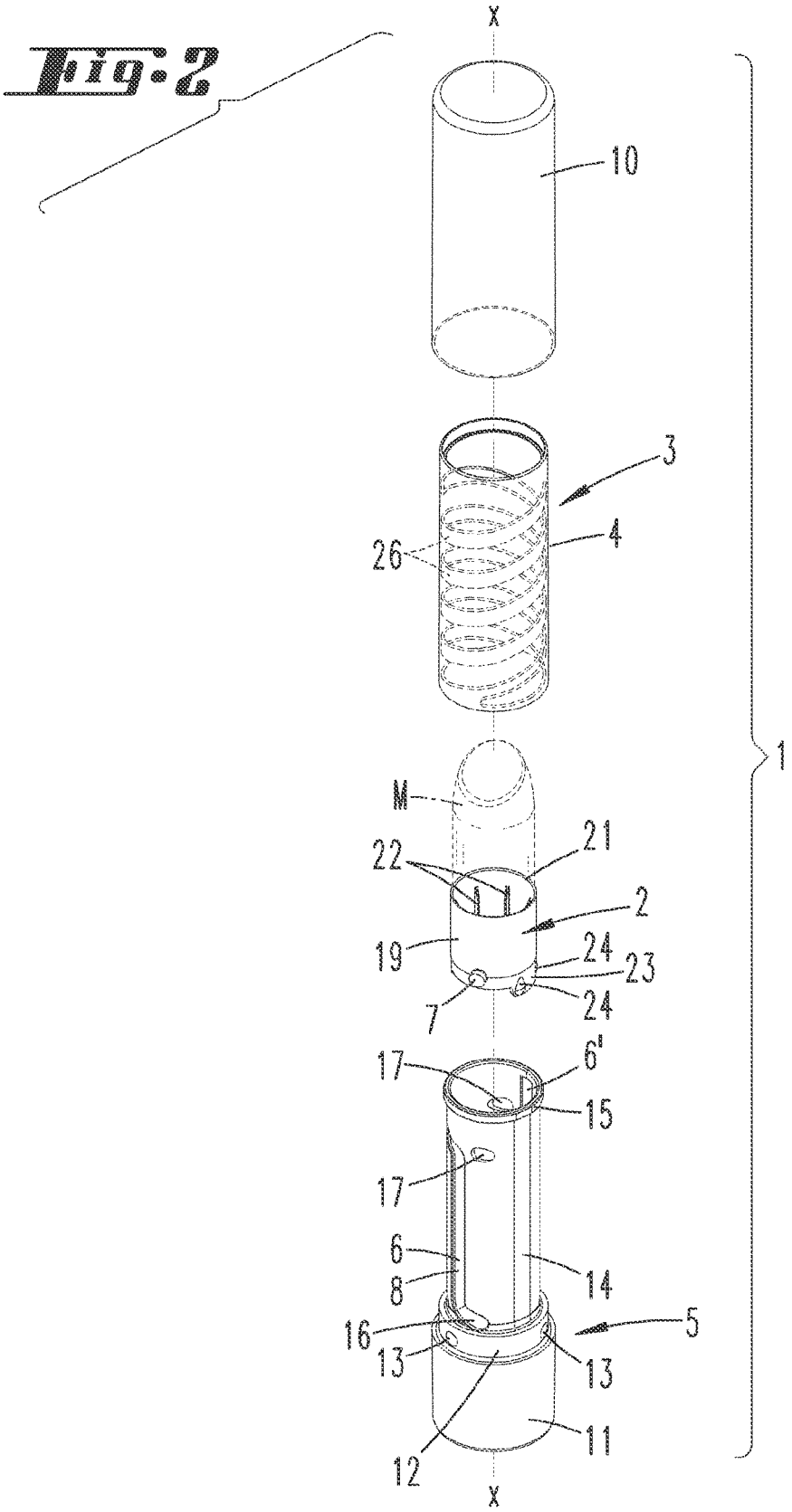
FIG. 2 shows a perspective exploded view of the device with a movement part, a substance carrier, a counter-retaining cylinder and a covering cap.
Figure 4:
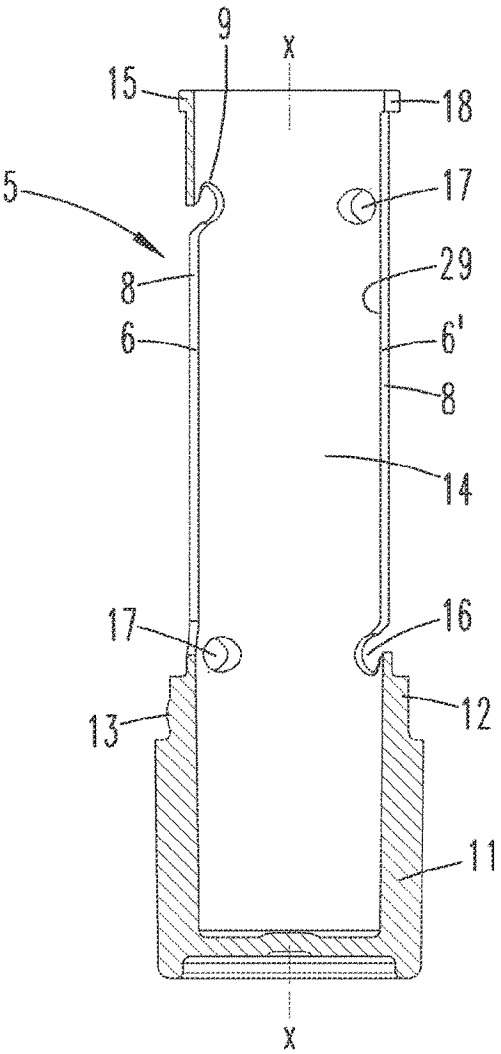
FIG. 4 shows the section along the line IV-IV in FIG. 3.

FIG. 2, in particular, shows that the device 1 essentially is composed of a substance carrier 2, a protective sleeve forming a counter-retaining cylinder 3 and a movement part 5.

The movement part 5 has a longitudinal slot 6, in which a peg 7 of the substance carrier 2 is guided, wherein the longitudinal slot 6 is composed of a movement portion 8, which extends parallel to a longitudinal axis x of the device 1, and a retaining portion 9 extending at an angle thereto.

Figure 1:
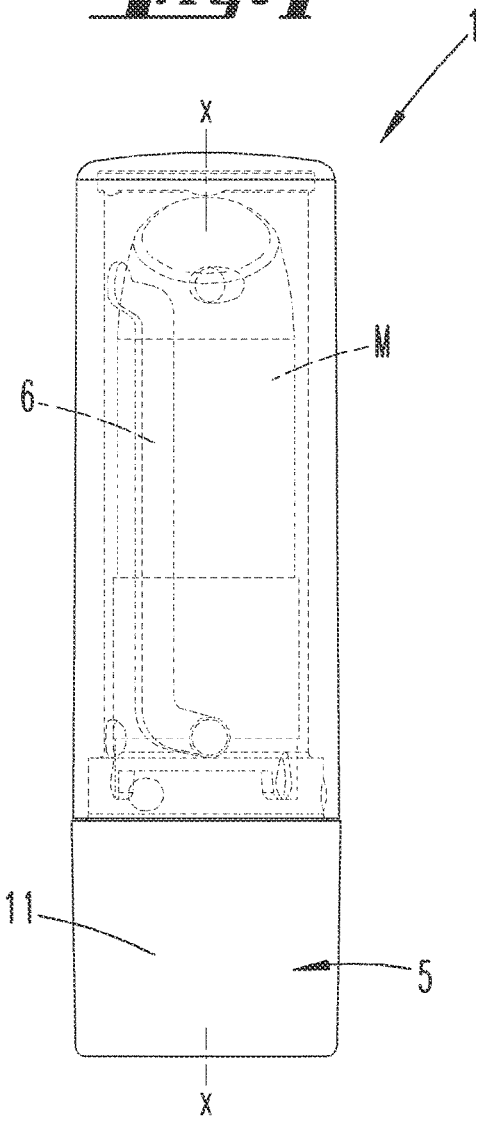
FIG. 1 shows a view of a device of the type in question concerning a closed storage position of the device.

The device 1, which according to the graphic representations may be realized in the form of a lipstick, furthermore may comprise a cap-shaped sleeve part 10 that serves as a protective cover for the substance M in the retracted non-usage position according to FIG. 1.

The device 1 as a whole may be realized in the form of a rotationally symmetrical cylinder and have a longitudinal axis x that forms the rotational axis. In this case, a longitudinal extent in the axial direction may approximately correspond to 3-times to 5-times, furthermore approximately 4-times, an outside diameter dimension measured transverse to the longitudinal axis x.

All parts of the device 1 preferably are made of plastic, particularly the same plastic, especially a rigid plastic, and furthermore respectively manufactured, for example, in a plastic injection moulding process. For example, all parts of the device 1 may consist of polypropylene.

The movement part 5, which is also illustrated individually in FIGS. 3 to 6, essentially is composed of portions that are arranged behind one another in the axial direction and preferably can be combined integrally and uniformly in material. A circular-cylindrical handling section 11 is thereby initially formed in the exemplary embodiment shown. This handling section may have an outside diameter that is adapted to the outside diameter of the sleeve part 10 and approximately extend in the axial direction over one-fourth of the total length of the device 1.

The handling section 11 may transform into a collar section 12, the diameter of which is reduced in comparison with the handling section 11, in a step-like manner. The outside diameter of this collar section preferably can be adapted to the inside diameter of the sleeve part 10 such that an attached sleeve part can in a preferred embodiment be supported on the step being formed between the handling section 11 and the collar section 12 with its end face.

Friction projections 13 provided on the outer wall of the collar section 12 interact with the inner wall surface of the sleeve part 10 in this closed position of the device. In this way, a frictional contact is produced in the closed position of the device and initially has to be overcome in order to remove the sleeve part 10.

Furthermore, a tubular guide section 14 follows this collar section 12 in the axial direction and has an outside diameter, which preferably is chosen smaller than the outside diameter of the collar section 12.

The outside diameter of the guide section 14 essentially is dimensionally adapted to the inside diameter of the movement part 5, wherein it is furthermore preferred that the outside diameter of the movement part 14 is in turn adapted to the outside diameter of the collar section 12. This may accordingly result in the formation of a step between the collar section 12 and the guide section 14, wherein the facing end face of the altogether sleeve-like movement part 5 can be supported on the free circumferential end face of said step.

The guide section 14 may carry a circumferential retaining collar 15, which protrudes radially outward, in the region of its free end that faces away from the handling section 11, wherein said retaining collar preferably has an outside diameter that is adapted to the outside diameter of the counter-retaining cylinder 3.

In this way, the counter-retaining cylinder 3 may be axially retained between the retaining collar 15 and the collar section 12 in an essentially non-displaceable manner, but the counter-retaining cylinder 3 preferably is freely rotatable relative to the movement part 5 about the longitudinal axis x.

Two longitudinal slots 6, 6' are provided in the guide section 14 diametrically opposite of one another with respect to the longitudinal axis x. These longitudinal slots essentially extend in alignment with the longitudinal axis x at least with a movement portion 8.

Figure 3:
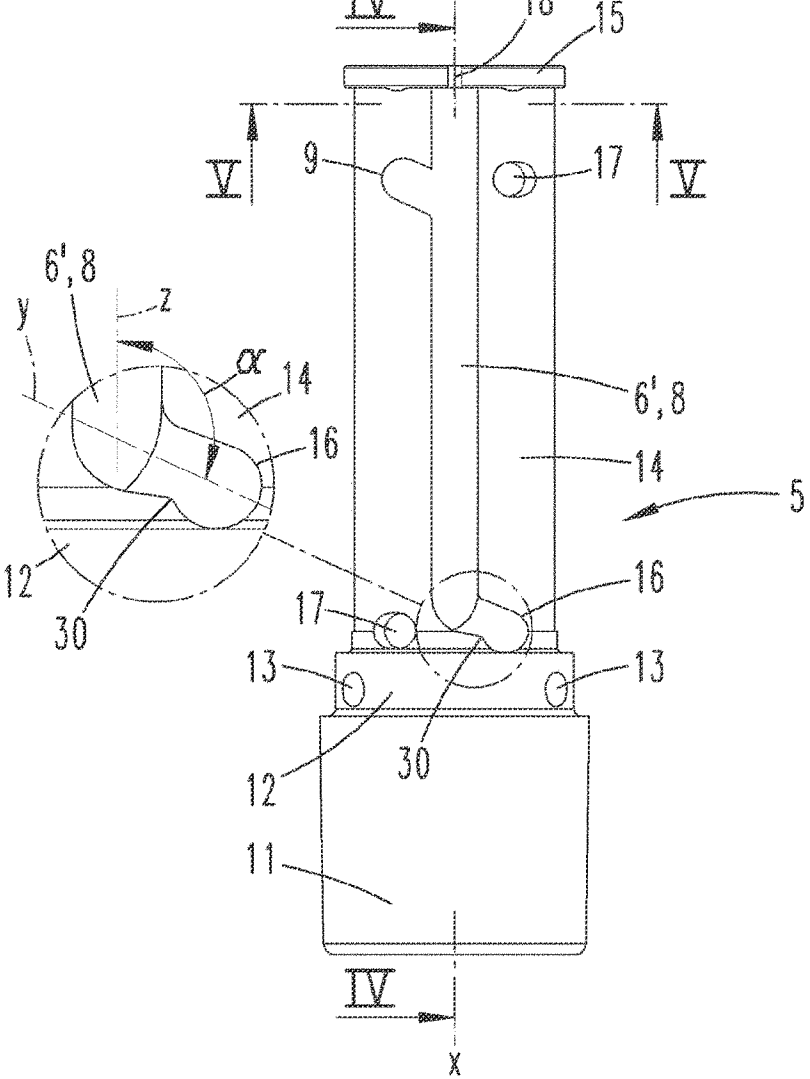
FIG. 3 shows an individual view of the movement part together with an enlarged detail.
Figure 6:
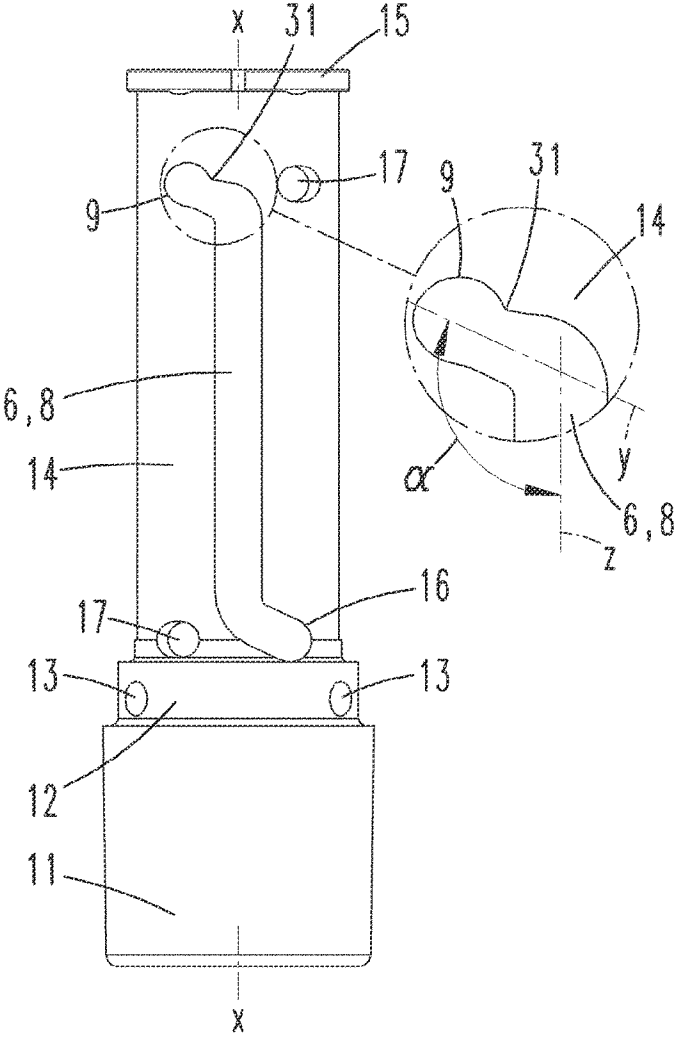
FIG. 6 shows a view, which in comparison with the illustration in FIG. 3 is rotated about a longitudinal axis of the movement part by 180 degrees, together with an enlarged detail.
Figure 5:
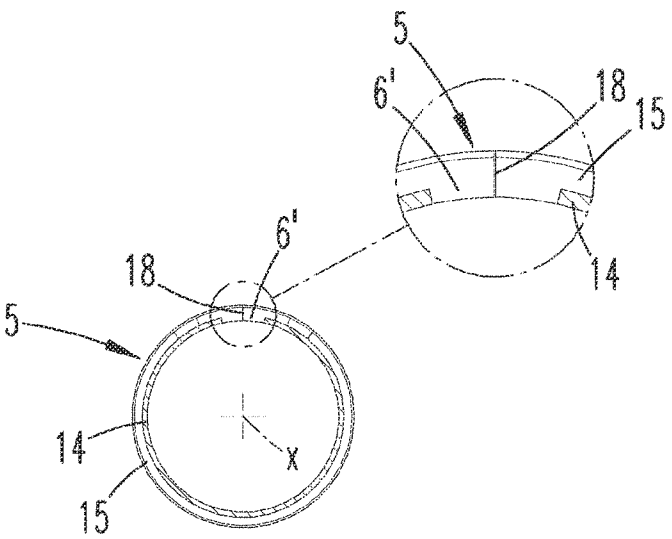
FIG. 5 shows the section along the line V-V in FIG. 3 together with a corresponding enlarged detail.
Figure 7:
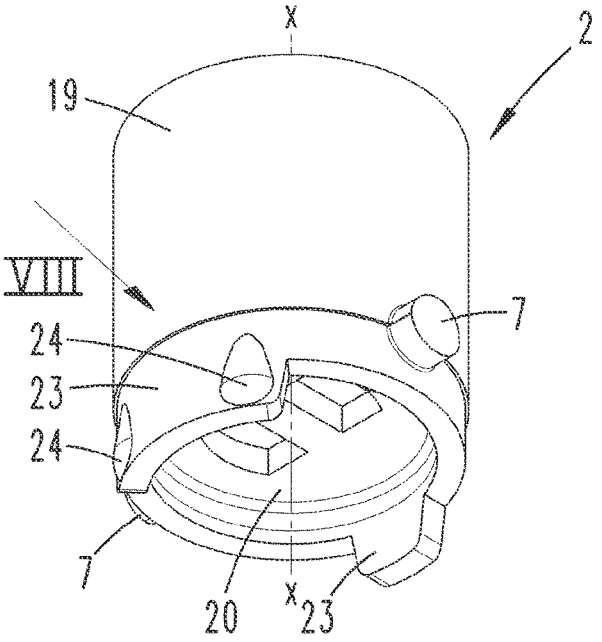
FIG. 7 shows an individual perspective view of the substance carrier.

The ends of these movement portions 8 respectively transform into retaining portions 9 in 16, wherein a central longitudinal axis y of such a retaining portion 9 or 16 and a central longitudinal axis z of the movement portion 8 may according to the enlarged details in FIGS. 3 and 6 include an obtuse angle a of approximately 110 to 115 degrees.

With respect to a top view of the device 1, in which the longitudinal axis x is illustrated in the form of a point, the retaining portions 9 of the longitudinal slots 6 and 6', which are assigned to the free end of the guide section 14, may be provided such that they are directed in the clockwise direction whereas the retaining portions 16 assigned to the end of the guide section 14 facing the collar section 12 may be realized such that they are directed in the counterclockwise direction.

Furthermore, the [text missing] to the free end of the guide section 14 are in a side view according to the illustrations in FIGS. 3 and 6 angled upward in the direction of the free end whereas the lower retaining portions 16 are angled downward in the direction of the collar section 12.

The upper retaining portions 9 defining a maximally extended position of the substance carrier 2 respectively may end at an axial distance from the free end or from the retaining collar 15 of the movement part 5 whereas the lower retaining portions 16 defining the retracted position essentially may end in the transition to the collar section 12 and optionally run into the step plane.

The peripheral wall of the guide section 14 may have bore-like openings 17 circumferentially offset to the respective end regions of the retaining portions 9 and 16. These openings can serve for improving the removability of the movement part 5 from a mould in the course of its preferred manufacture in a plastic injection moulding process.

The illustration in FIG. 3, in particular, furthermore shows that the longitudinal slot 6' extends beyond the region of the inlet into the upper retaining portion 9, preferably as far as the retaining collar 15, whereas the movement portion 8 of the longitudinal slot 6 ends according to the illustration in FIG. 6 with the transition into the retaining portion 9.

The retaining collar 15 may be separated by a radial separation 18 in the region of the extended longitudinal slot 6' in order to allow an advantageous installation of the substance carrier 2.

The substance carrier 2, which acts in a piston-like manner, is individually illustrated in FIGS. 7 to 13.

Figure 17:
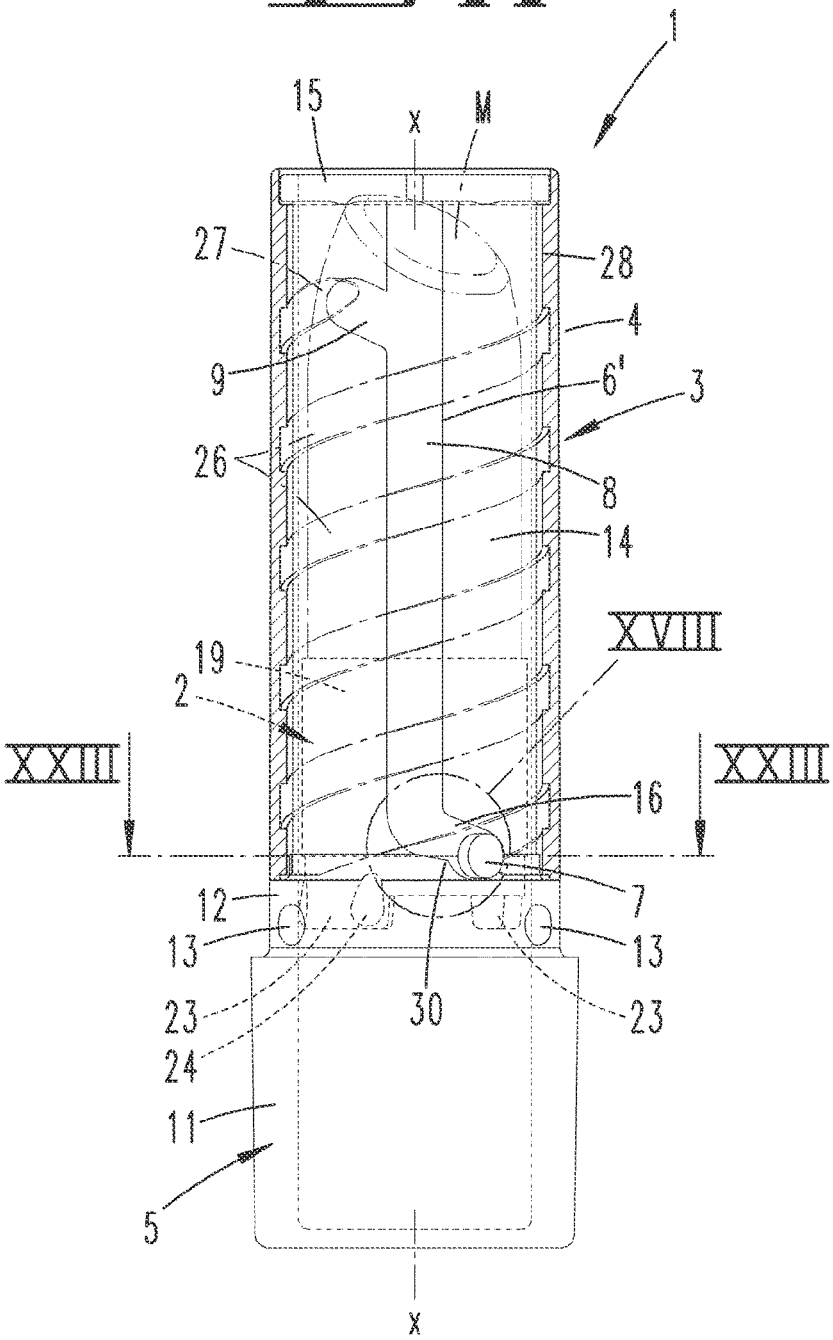
FIG. 17 shows a partially sectioned representation of the device after the removal of the cap, wherein the substance carrier is arranged in a maximally retracted position.

The substance carrier 2 initially and essentially comprises a circumferential carrier wall 19 and a carrier bottom 20 that is recessed transverse thereto. In the normal operating position, e.g. according to FIG. 17, the substance carrier 2 has a cup opening 21, which is delimited by the carrier wall 19 and the carrier bottom 20 and open toward the top. The bottom side of the substance M, e.g. in the form of a lip care stick, is accommodated in this cup-shaped section of the substance carrier 2.

Multiple webs 22, which are directed radially inward, may be integrally formed on the inner side of the cup, particularly on the inner side of the carrier wall 19, in uniform circumferential distribution in order to positively connect the substance M to the substance carrier 2. With respect to a cross section transverse to the longitudinal axis x according to FIG. 13, as well as the enlarged detail in FIG. 13, these webs may starting from the inner wall surface be shaped such they extend radially inward in a pointed manner similar to blades.

According to the exemplary embodiment shown, eight webs 22 of this type may be distributed over the circumference.

Figure 12:
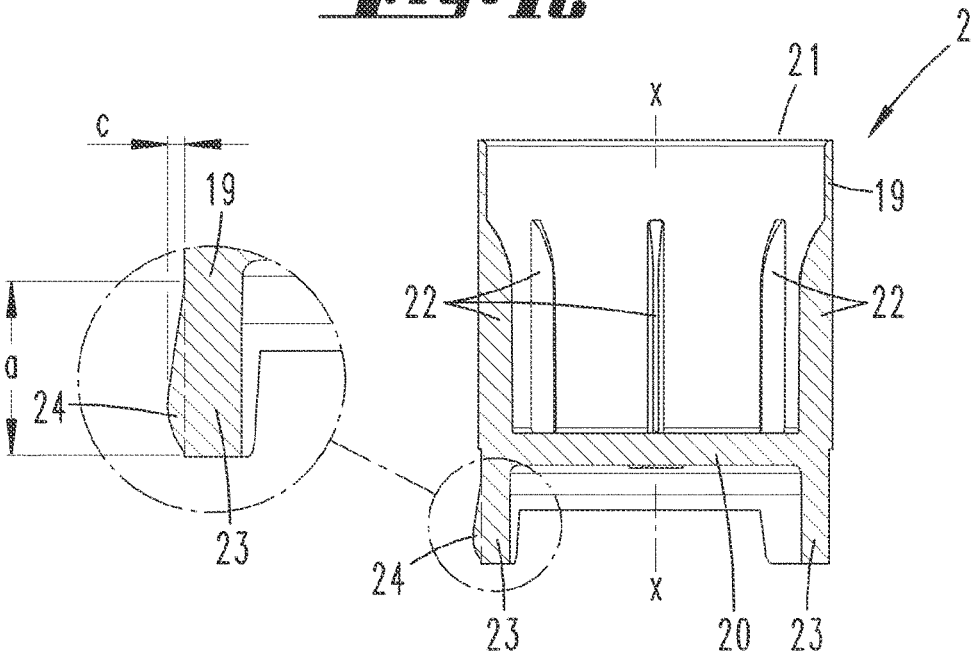
FIG. 12 shows the section along the line XII-XII in FIG. 10 together with an enlarged detail.
Figure 13:
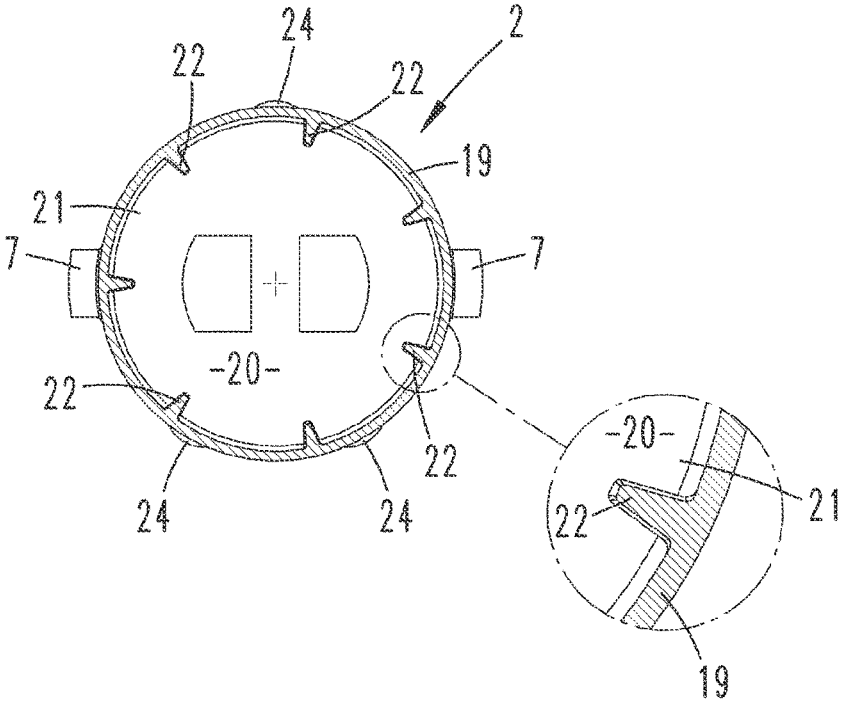
FIG. 13 shows the section along the line XIII-XIII in FIG. 8 together with an enlarged detail.
Figure 14:
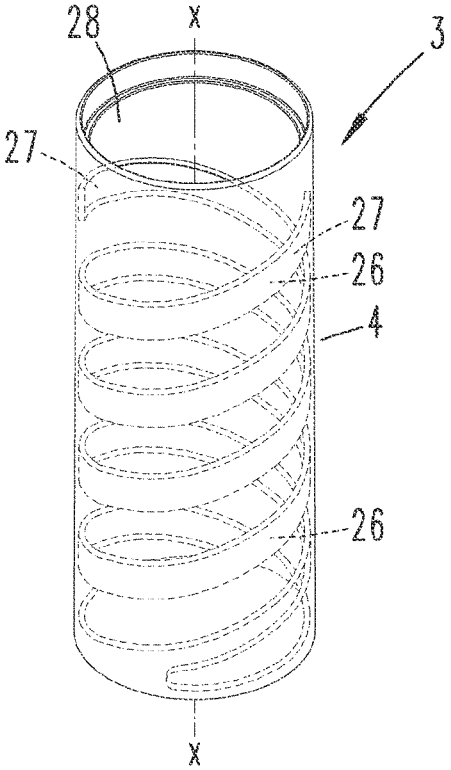
FIG. 14 shows an individual perspective view of the counter-retaining cylinder.

The webs 22 extend in the axial direction starting from the carrier bottom 20 and according to the illustration in FIG. 12 end at a distance from the free outer edge of the cup opening 21.

The carrier wall 19 extends beyond the underside of the carrier bottom 20, e.g. with an axial length that approximately corresponds to half or one-third of the axial length of the carrier wall 19, in order to form the cup for accommodating the substance M.

The illustrations in FIGS. 7 to 10, in particular, show that the carrier wall 19 does not necessarily have to be provided over the entire circumference in this section extending on the underside of the carrier bottom 20. According to the exemplary embodiment shown, two wall sections 23 with different circumferential extents may be formed over the circumference.

Radially protruding friction cams 24 may be integrally formed on the outer side of these wall sections 23 as shown. For example, three friction cams 24 of this type may altogether be distributed over the circumference.

Figure 8:
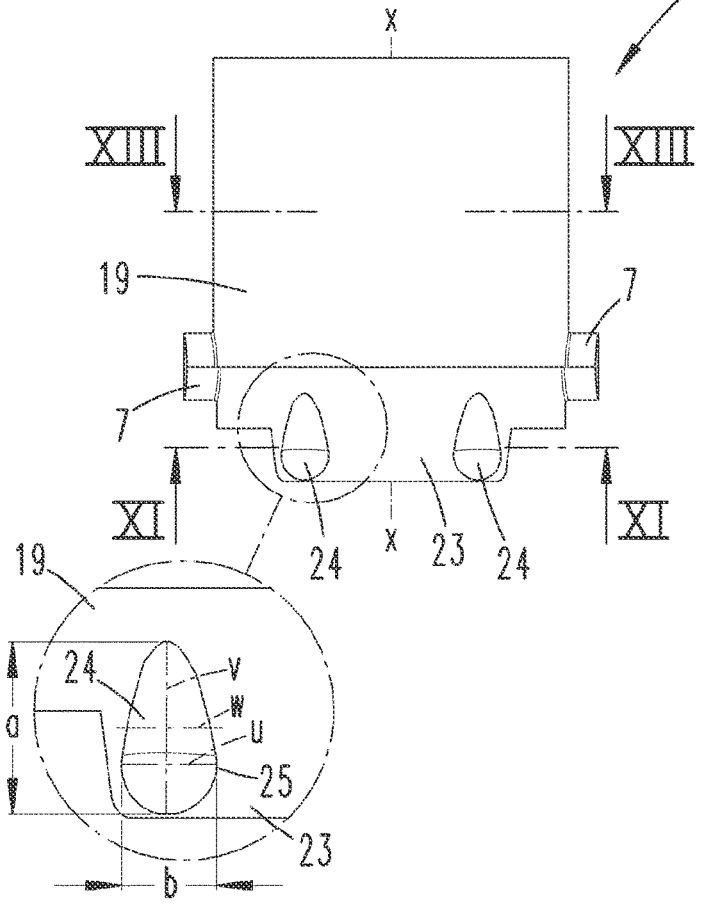
FIG. 8 shows a view of the substance carrier in the direction of the arrow VIII in FIG. 7 together with an enlarged detail.
Figure 9:
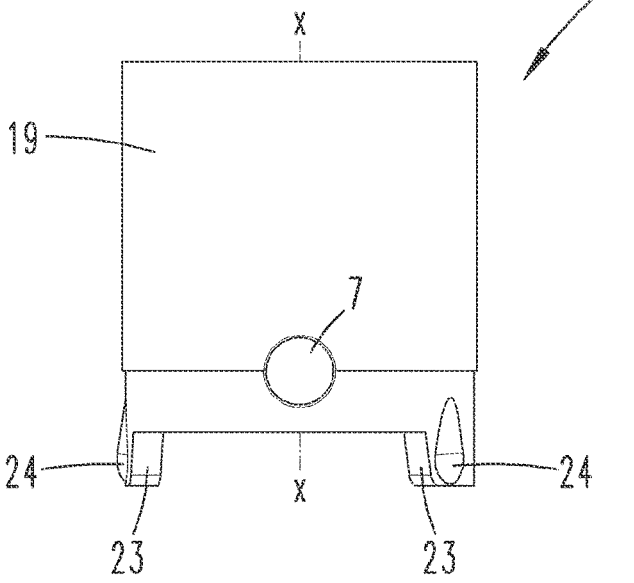
FIG. 9 shows another view of the substance carrier, which in comparison with FIG. 8 is rotated about a longitudinal axis of the substance carrier by 90 degrees.
Figure 10:
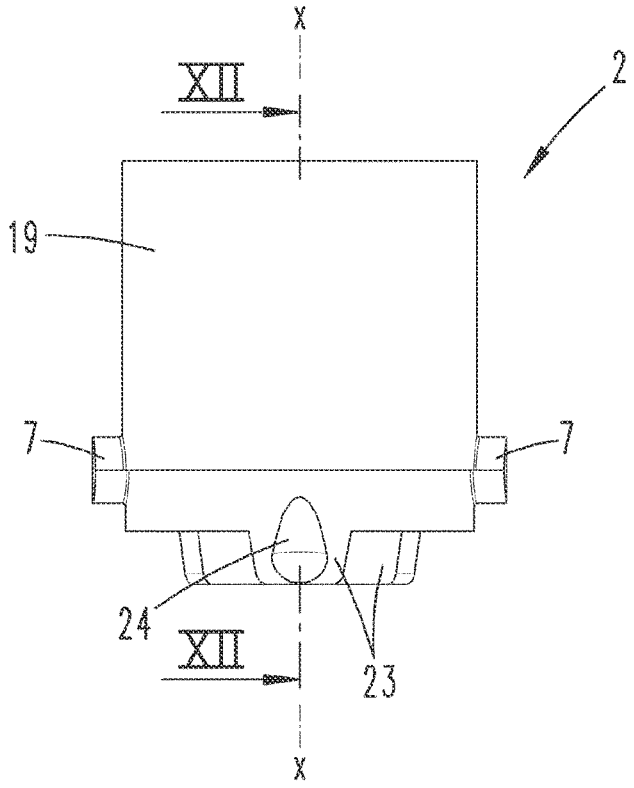
FIG. 10 shows a rear view of the substance carrier illustrated in FIG. 8.
Figure 11:
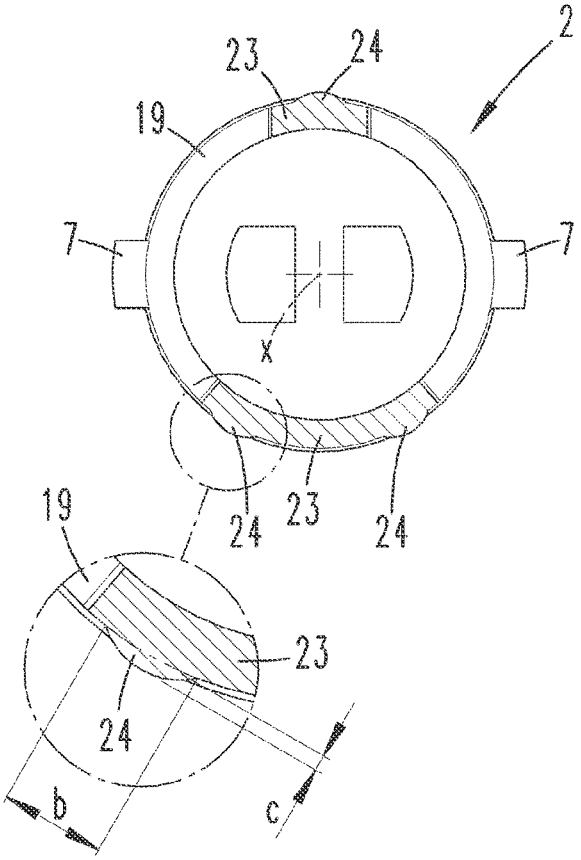
FIG. 11 shows the section along the line XI-XI in FIG. 8 together with an enlarged detail.

With respect to a view from radially outside according to the illustration in FIG. 8 or FIG. 10, each friction cam 24 essentially may have a drop-shaped outer edge, i.e. a drop-shaped contour 25, with a longer dimension a and a shorter dimension b, wherein the longer dimension a essentially extends in the direction of the longitudinal axis x and therefore in the direction of the movement portion 8 of the longitudinal slots 6 and 6'. The shorter dimension b may extend perpendicular thereto, preferably in essentially the circumferential direction.

In this case, a greatest dimension of a friction cam 24 along a line u extending in the circumferential direction furthermore may extend eccentric to a center line w referred to a greatest dimension along a line v in the longitudinal direction, with respect to the illustrations preferably underneath said center line and accordingly facing away from the substance M to be accommodated (see, in particular, the enlarged detail in FIG. 8).

The enlarged detail in FIG. 12, in particular, furthermore shows that a drop shape of the friction cam 24 is also formed with respect to the radially outward elevation. The friction cam 24 protrudes in a bulging manner and has a radially outer reversal point, which with respect to a vertical section according to FIG. 12 essentially lies approximately in the region of the line u representing the greatest dimension in the transverse direction.

The maximum radial protruding dimension c of such a friction cam 24 may approximately correspond to one-third to one-fourth of the greatest dimension of the friction cam 24 in the circumferential direction along the line u.

In addition, two diametrically opposed pegs 7 are provided on the outer side of the carrier wall 19 at approximately the axial height of the carrier bottom 20. These pegs 7 essentially may be realized circular-cylindrical and made of a solid material as shown.

The diameter of the pegs 7 preferably can be adapted to the circumferentially measured clearance between the facing outer edges of the movement portions 8 of the longitudinal slots 6 and 6'.

In other respects, the retaining portions 9 in 16 are likewise adapted to this clearance such that the pegs 7 are also securely guided during a corresponding displacement of the substance carrier 2 in the region of the retaining portions 9 and 16.

The counter-retaining cylinder 3 is on its inner side provided with two control grooves 26, which with respect to the cylinder axis x are offset relative to one another by 180 degrees and rise along the inner peripheral wall in the form of screw threads. According to the exemplary embodiment shown, these control grooves 26, which are realized similar to a double thread, extend over approximately 2.5 revolutions with a preferably constant pitch, namely from the end of the counter-retaining cylinder 3 facing the collar section 12 in the direction of the end covered by the retaining collar 15.

In this case, the control grooves 26 may taper off freely in the end face of the counter-retaining cylinder 3, which optionally is supported on the collar section 12, whereas the opposite ends preferably end at a distance from the end of the counter-retaining cylinder 3 on the side of the retaining collar.

Figure 15:
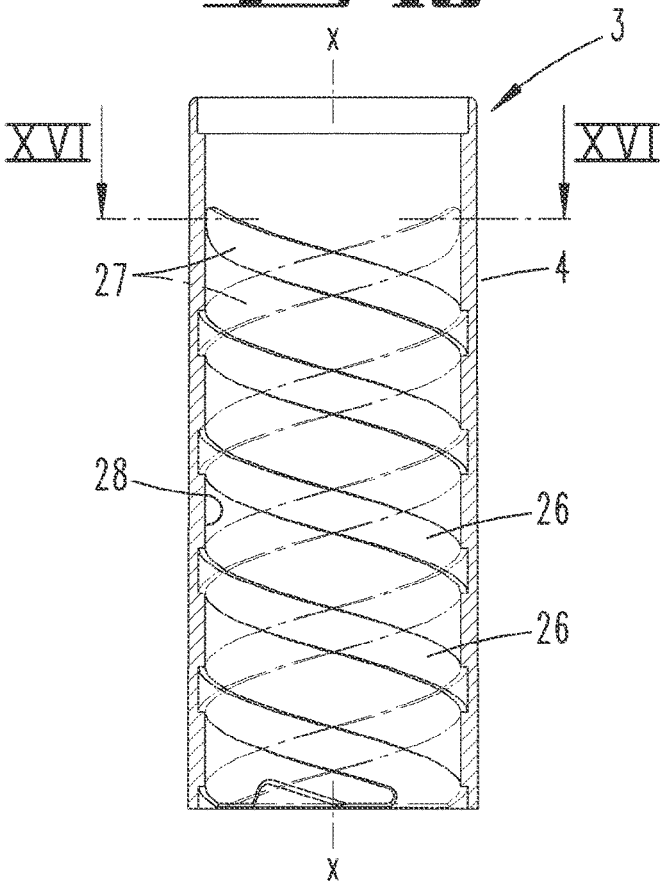
FIG. 15 shows a longitudinal section through the counter-retaining cylinder.
Figure 16:
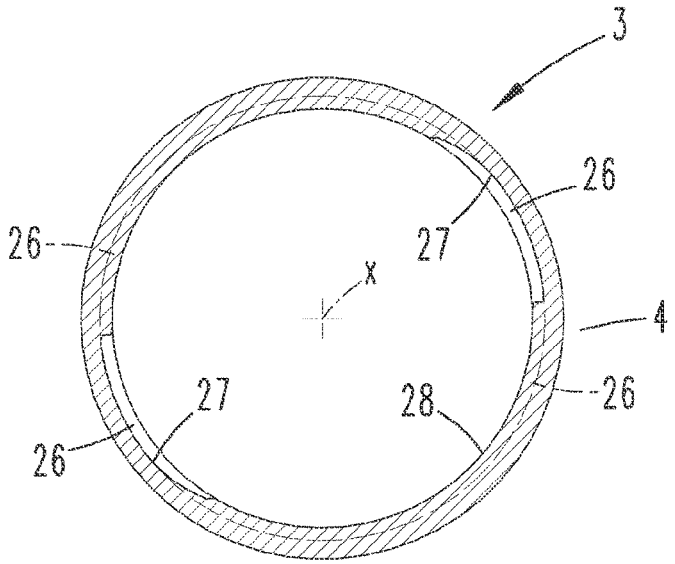
FIG. 16 shows the enlarged section along the line XVI-XVI in FIG. 15.

The illustrations in FIGS. 15 and 16, in particular, show that the control groove end, which is formed at a distance from the end region of the counter-retaining cylinder 3, preferably can lead into an inclined surface 27 that ultimately transforms into the inner surface 28 of the counter-retaining cylinder 3, optionally with uniform reduction of the groove depth.

The substance carrier 2 is arranged in the device 1 in such a way that it is encompassed by the guide section 14 of the movement part 5, as well as by the counter-retaining cylinder 3 that at the same time encompasses the guide section 14.

The pegs 7 of the substance carrier 2 extend through the longitudinal slots 6 and 6' of the movement part 5 in this case and penetrate into the control grooves 26 of the counter-retaining cylinder 3 with their radially outer end sections.

The friction cams 24 are in frictional contact with the inner surface 29 of the movement part 5 or the guide section 14, respectively.

As a result of this arrangement, a relative rotational displacement between the counter-retaining cylinder 3 and the movement part 5 can be achieved by holding the device 1 on the counter-retaining cylinder 3 and by taking hold of and rotating the movement portion 8 in the region of the handling section 11, wherein the substance carrier 2 can thereby be moved in the direction of the longitudinal axis x along the longitudinal slots 6 and 6' by means of the pegs 7 guided in the control grooves 26 of the counter-retaining cylinder 3.

FIGS. 17 to 24 show a lowermost and therefore maximally retracted position of the substance carrier 2 and of the substance M carried by the substance carrier 2.

Figure 24:
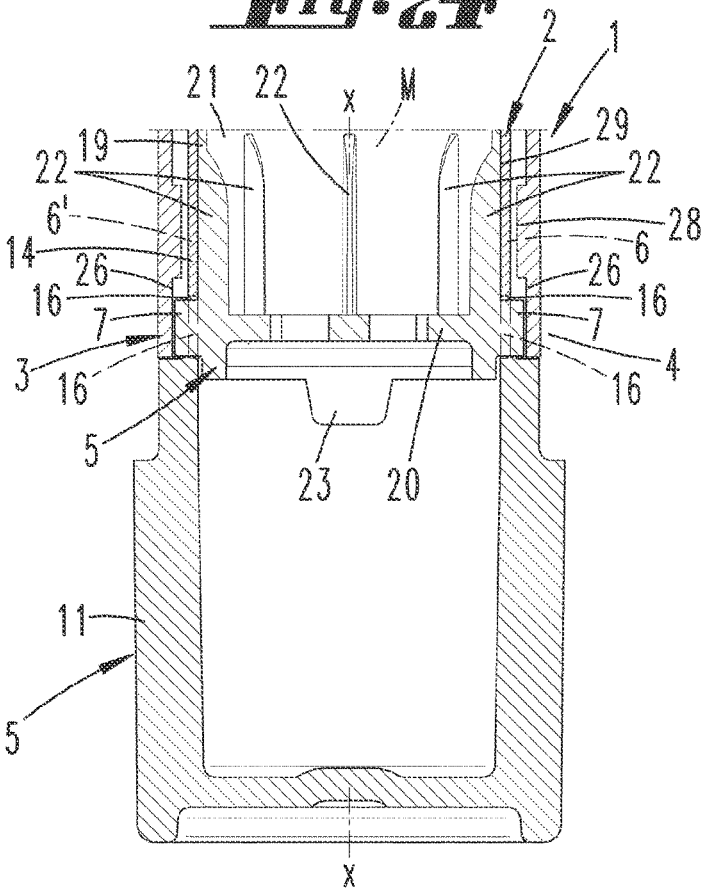
FIG. 24 shows the section along the line XXIV-XXIV in FIG. 23.
Figure 25:
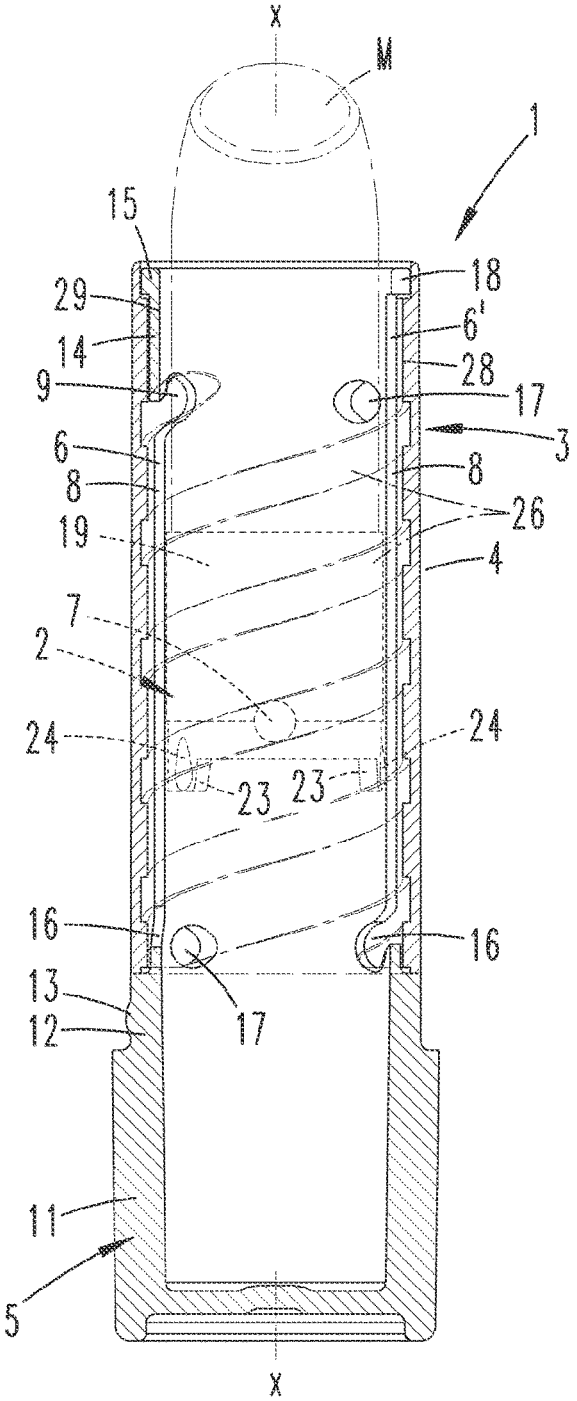
FIG. 25 shows a longitudinal section through the device concerning an intermediate position of the substance carrier between a retracted position and an extended position.
Figure 26:
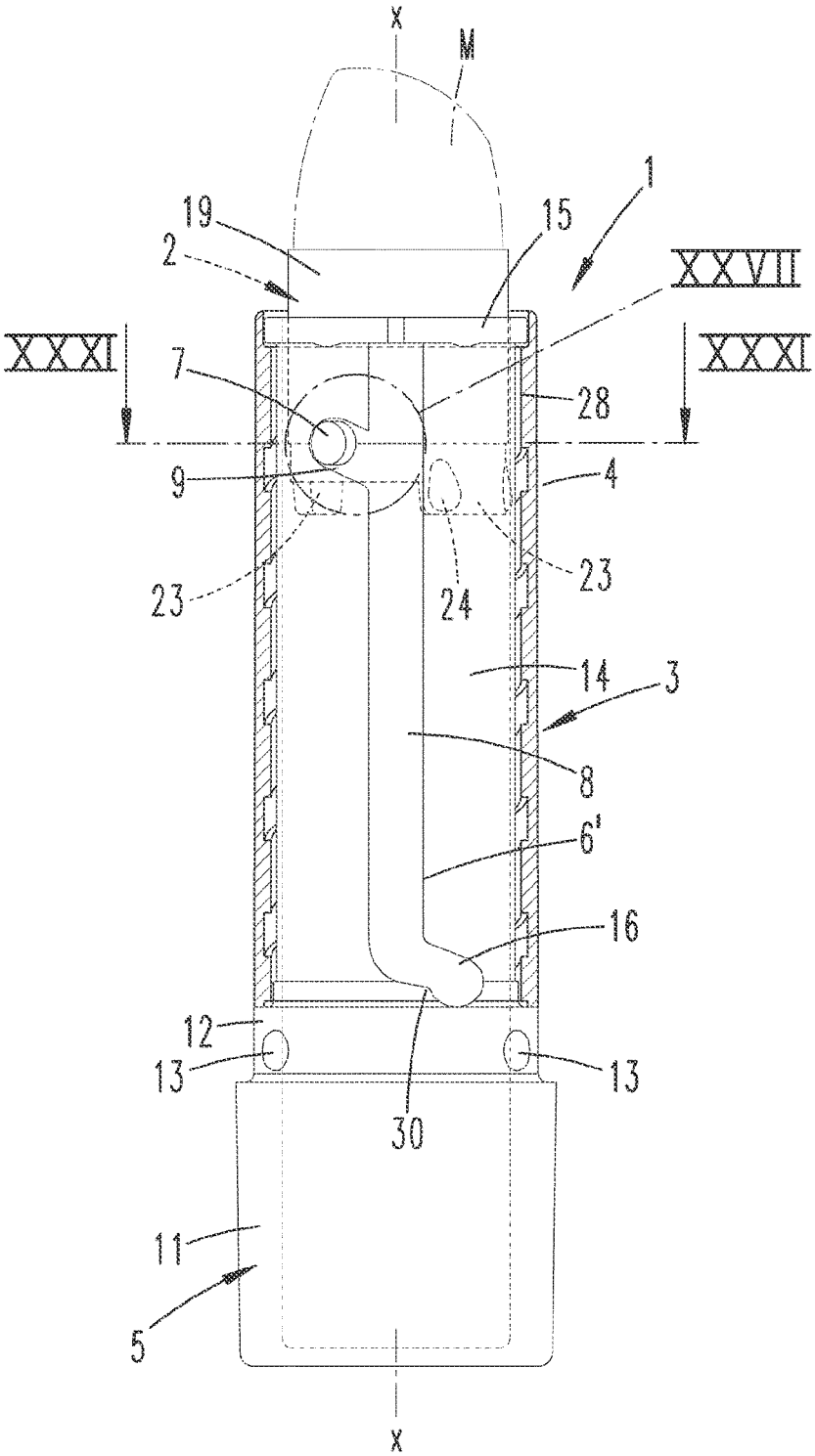
FIG. 26 shows a representation corresponding the FIG. 17, but concerning the maximally extended position of the substance carrier.
Figure 27:
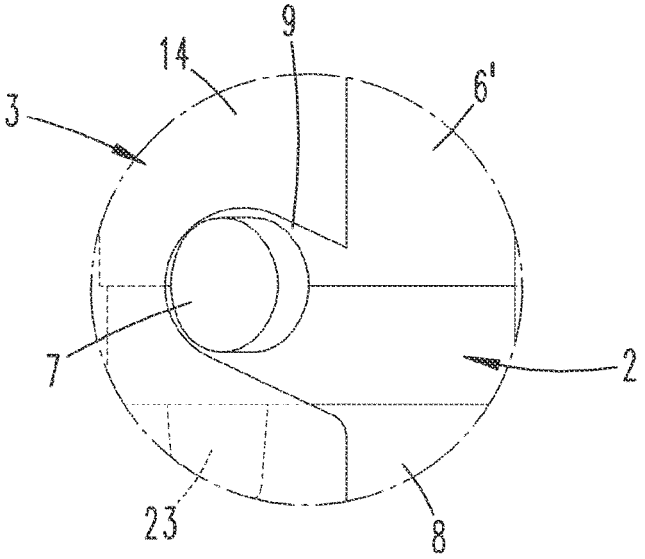
FIG. 27 shows an enlarged detail of the region XXVII in FIG. 26.
Figure 28:
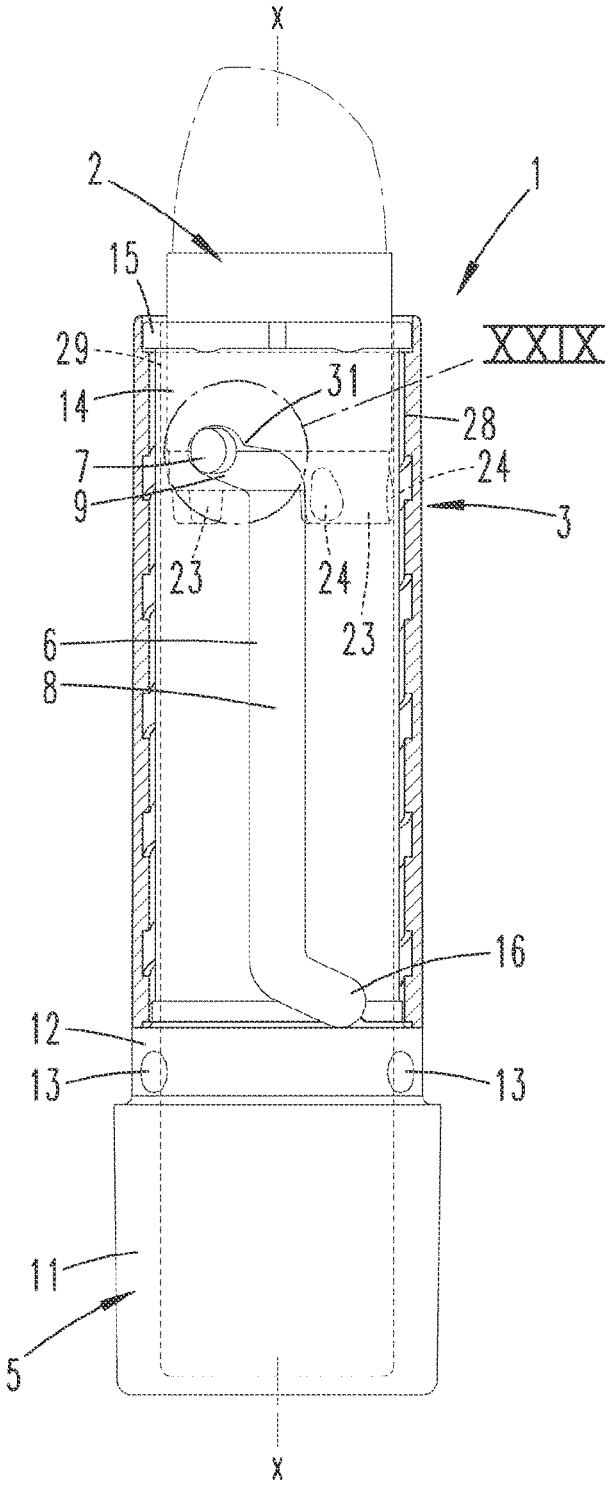
FIG. 28 shows a representation corresponding to FIG. 20, but concerning the substance carrier position according to FIG. 26.

The section in FIG. 24, in particular, shows that the substance carrier 2 can in this case be supported on the base of the lower retaining portion 16 defining the retracted position by means of its peg 7, optionally directly on the step that is formed between the collar section 12 and the guide section 14 and into which the base of the retaining portion 16 can run.

This maximally retracted position may be designed such that it can be overrun opposite to the normal rotating direction for displacing the substance carrier 2 in the direction of the extended position. This effect can be promoted by the control grooves 26, which are tapered off freely without edges toward this end of the counter-retaining cylinder 3.

Figure 18:
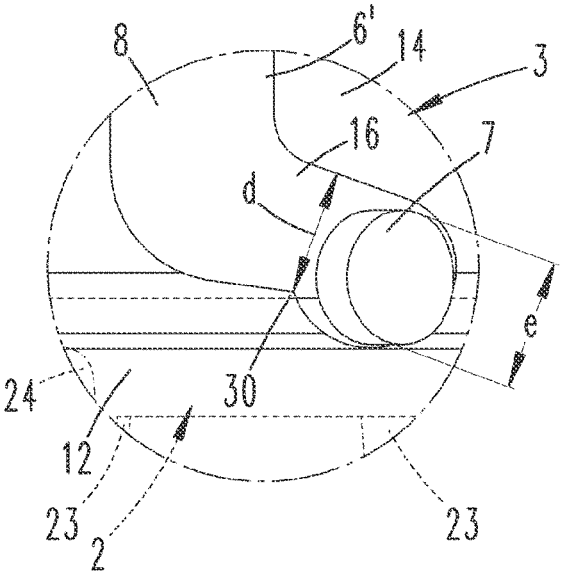
FIG. 18 shows an enlarged detail of the region XVIII in FIG. 17 concerning a catch-secured retracted position of a peg of the substance carrier in a retaining portion of the movement part.
Figure 21:
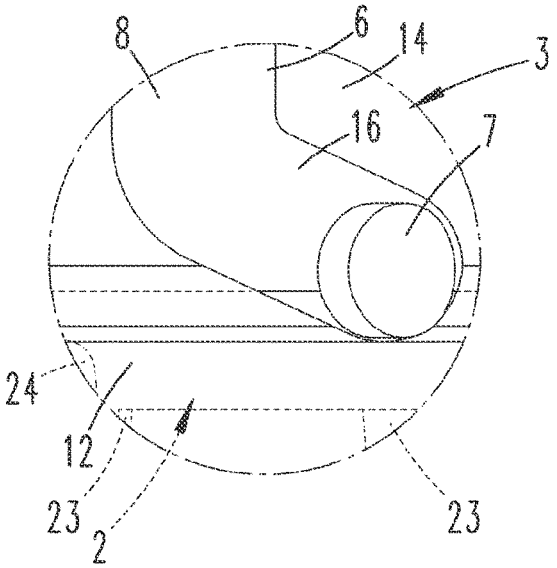
FIG. 21 shows an enlarged detail of the region XXI in FIG. 20.
Figure 22:
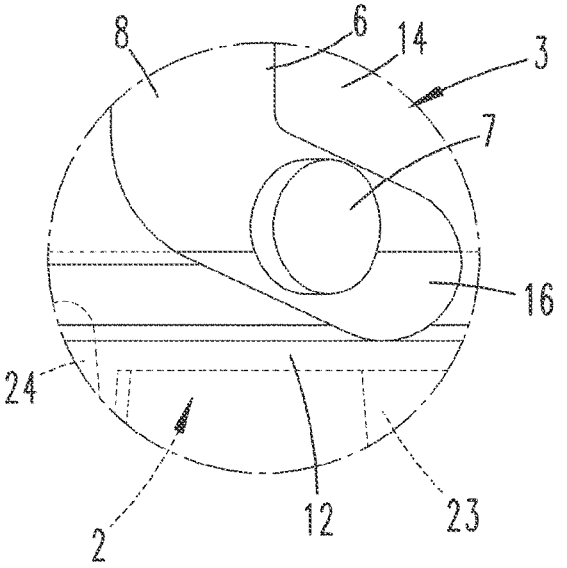
FIG. 22 shows a detail corresponding to FIG. 21, but concerning an intermediate position according to FIG. 19.
Figure 23:
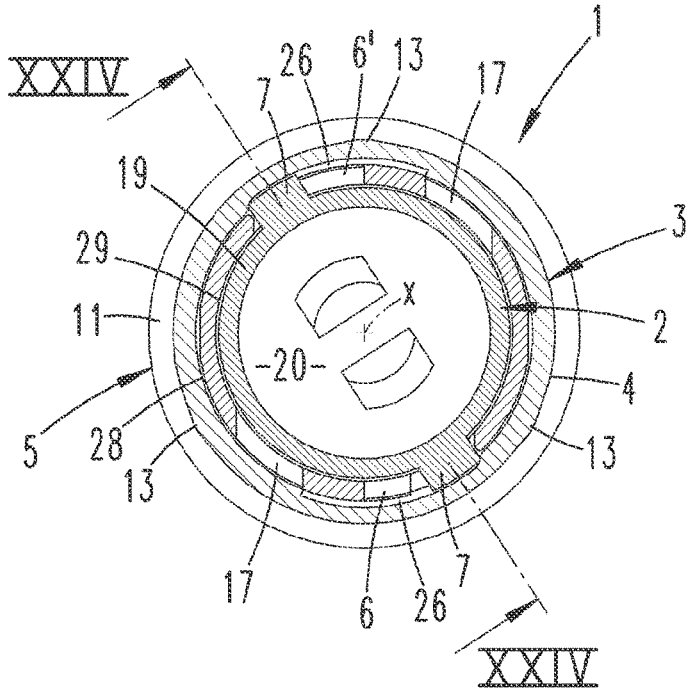
FIG. 23 shows the section along the line XXIII-XXIII in FIG. 17.

The position of the peg 7 in the lower retaining portion 16 is illustrated, for example, in FIGS. 18 and 21. These figures furthermore show that at least one retaining portion 16 of a longitudinal slot (in this case the longitudinal slot 6') has a catch projection 30 that can be overrun by the peg 7. This catch projection 30 may form a constriction of the clear passage dimension of the retaining portion 16.

The passage dimension d of the retaining portion 16, which is reduced by the catch projection 30, may approximately correspond to 0.9-times to 0.95-times the diameter dimension e of the peg 7 (compare to FIG. 18).

Figure 19:
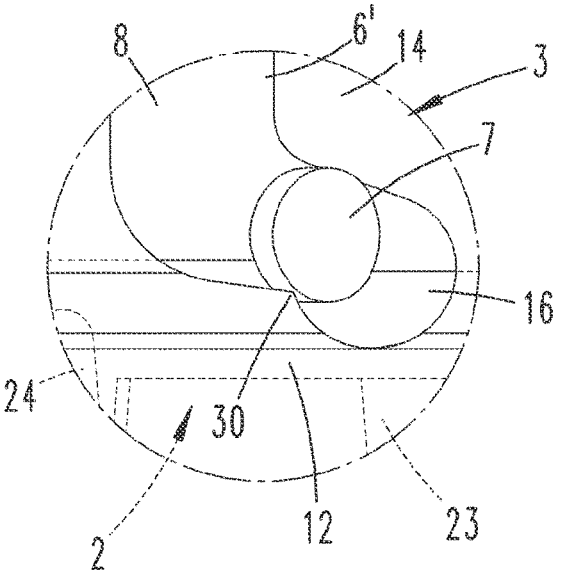
FIG. 19 shows a detail corresponding to FIG. 18, but concerning an overrunning position of the peg by overcoming the catch projection in the retaining portion.
Figure 20:
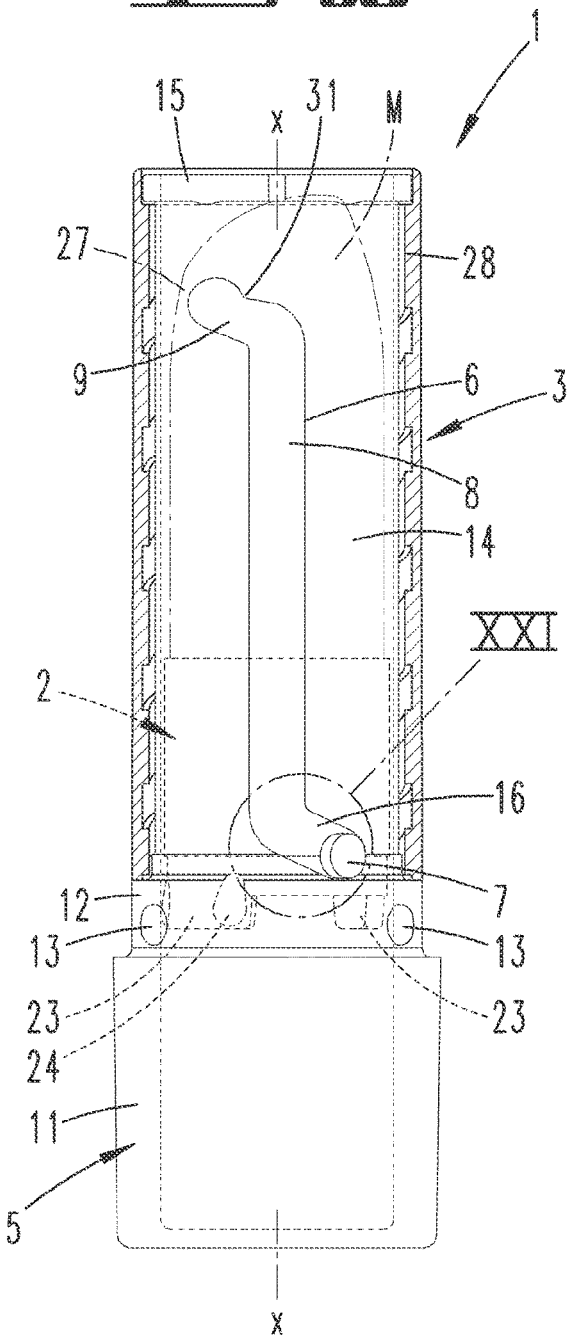
FIG. 20 shows a representation according to FIG. 17, but concerning a respective view or sectioned view, which in comparison with the illustration in FIG. 17 is rotated about the longitudinal axis of the device by 180 degrees.

FIG. 19 shows an intermediate position, in which the peg 7 overcomes the catch projection 30. Accordingly, the catch projection 30 can only be overcome intentionally due to a relative rotational displacement caused by the user. The catch projection 30 can be overrun as a result of the design of the components of an elastic plastic material.

The retaining portion 16 of the other longitudinal slot 6 is not provided with such a catch projection 30 in the exemplary embodiment shown. However, it would in this respect also be conceivable to form catch projections 30 in the region of both lower retaining portions 16.

Once the catch projection 30 has been overcome, the substance carrier 2 leaves the retracted position and is successively advanced axially along the movement portion 8 of the longitudinal slots 6 and 6' as a result of a relative rotational displacement between the movement part 5 and the counter-retaining cylinder 3 in order to displace the substance M beyond the openly designed free end of the counter-retaining cylinder 3 and the movement part 5.

The maximally possible extended position is illustrated in FIGS. 26 to 32. In this case, the pegs 7 are after passage of the movement portions 8 of both longitudinal slots 6 and 6' moved into the retaining portions 9 extending at an obtuse angle thereto. In the process, the substance carrier 2 carries out a rotational movement about the longitudinal axis x by a few degrees, e.g. approximately 10 degrees, together with the substance M accommodated therein as it is also the case when leaving the retracted position.

The maximally extended position is defined as a result of a stop limitation in the retaining portions 9. This maximally extended position preferably can be designed such that it cannot be overrun. For example, the respective peg 7 may be captured between facing outer edges of the control grooves 26 and the retaining portion 9.

Figure 29:
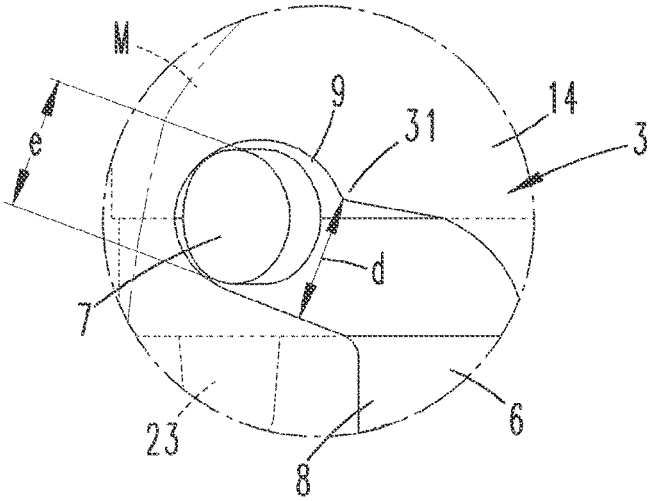
FIG. 29 shows an enlarged detail of the region XXIX in FIG. 28.

The illustration in FIG. 29, in particular, a furthermore shows that the maximally extended position may also be secured by an additional catch projection 31. According to the exemplary embodiment shown, such a catch projection 31 may be provided in a retaining portion 9, preferably in the retaining portion 9 of the longitudinal slot 6. In the exemplary embodiment shown, the retaining portion 9 of the other longitudinal slot 6' is not provided with such a catch projection 31 although this would be readily possible in another embodiment.

The catch projection 31 and the catch projection 30 in the region of the lower retaining portion 16 essentially may be designed identically. In this respect, identical relations between the passage dimension d in the region of the retaining portion 9, which is reduced by the catch projection 31, and the diameter e of the peg 7 may be realized.

Figure 30:
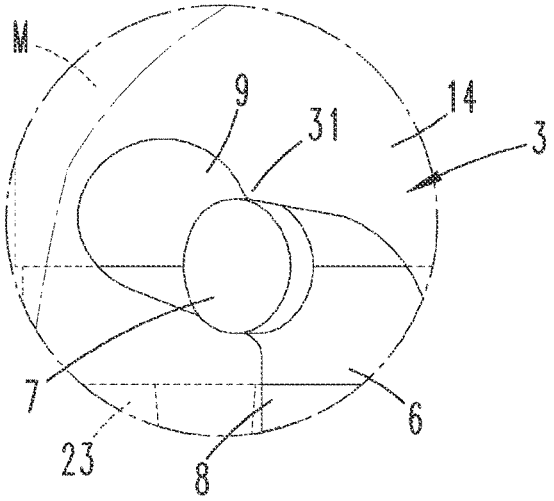
FIG. 30 shows a representation corresponding to FIG. 29, but concerning an intermediate position in the course of overrunning a catch projection of the retaining portion accommodated by the peg of the substance carrier in the maximally extended position.
Figure 31:
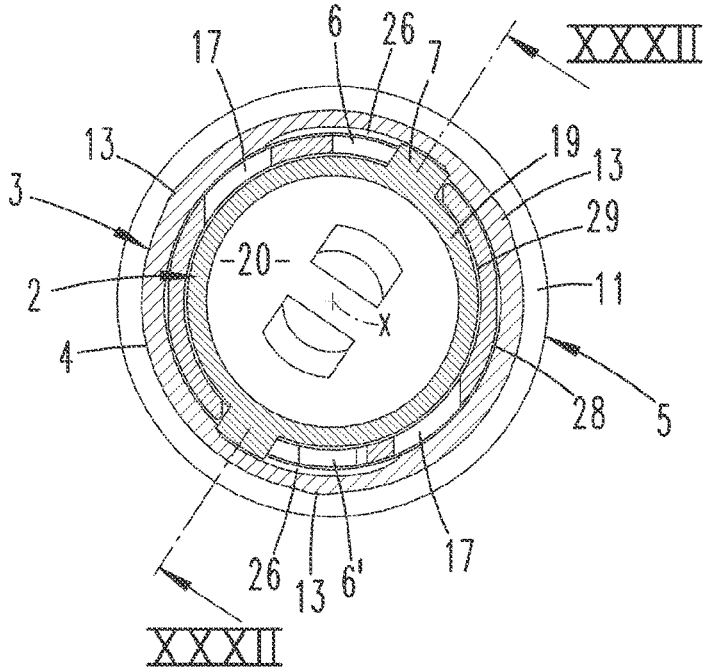
FIG. 31 shows the section along the line XXXI-XXXI in FIG. 26.
Figure 32:
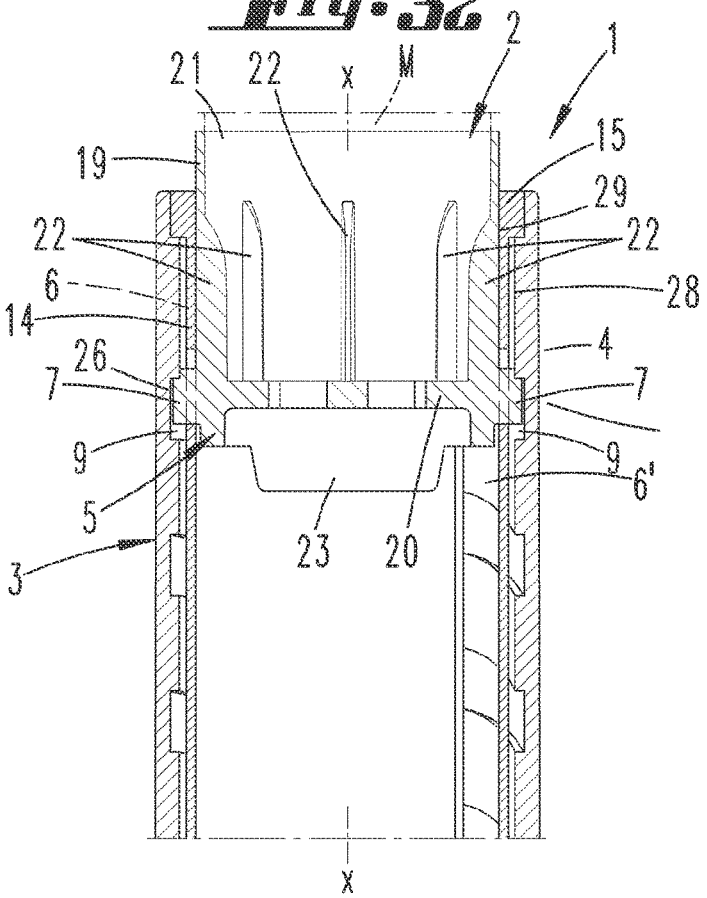
FIG. 32 shows the section along the line XXXII-XXXII in FIG. 21.

FIG. 30 shows a situation, in which the peg 7 overruns the catch projection 31. Accordingly, the withdrawal from the maximally extended position also can only be realized intentionally due to a relative rotation caused by the user.

LIST OF REFERENCE SYMBOLS

1 Device
2 Substance carrier
3 Counter-retaining cylinder
4 Protective sleeve
5 Movement apart
6 Longitudinal slot
6' Longitudinal slot
7 Peg
8 Movement portion
9 Retaining portion
10 Sleeve part
11 Handling section
12 Collar section
13 Friction projection
14 Guide section
15 Retaining collar

16 Retaining portion
17 Opening
18 Radial separation
19 Carrier wall
20 Carrier bottom
21 Cup opening
22 Web
23 Wall section
24 Friction cam
25 Outer edge
26 Control groove
27 Inclined surface
28 Inner surface
29 Inner surface
30 Catch projection
31 Catch projection
a Dimension
b Dimension
c Dimension
d Dimension
e Diameter
u Line
v Line
w Center line
x Longitudinal axis
y Central longitudinal axis
z Central longitudinal axis
M Substance
a Angle

The invention claimed is:

1. A device (1) for applying a transferable substance (M) in the form of a stick, comprising:

a substance carrier (2), a protective sleeve (4) for the substance carrier (2), wherein the substance carrier (2) is configured to be displaced relative to the protective sleeve (4) in order to displace a free end region of the substance (M) into a freely projecting position, and a movement part (5) with a longitudinal slot (6, 6'), in which the substance carrier (2) is guided with a peg (7) engaging into the longitudinal slot (6, 6') such that the substance carrier (2) can be moved between a retracted position and an extended position, wherein the longitudinal slot (6, 6') has a retaining portion (9) assigned to the extended position, wherein a central longitudinal axis (y) of said retaining portion extends at an angle to a central longitudinal axis (z) of a movement portion (8) of the longitudinal slot (6, 6'), wherein the central longitudinal axis (y) of the retaining portion (9) and the central longitudinal axis (z) of the movement portion (8) include an obtuse angle (a), wherein the substance carrier (2) is accommodated in a counter-retaining cylinder (3), in an inner wall of which a control groove (26) for the peg (7) is formed, wherein the control groove (26) has assigned to the extended position an inclined surface (27) that leads to a transition to the cylindrical inner surface (28) of the counter-retaining cylinder (3), and wherein the peg (7) is not or only partially in overlap with the inclined surface (27) in the extended position.

2. A device (1) for applying a transferable substance (M) in the form of a stick, comprising:

a substance carrier (2), a protective sleeve (4) for the substance carrier (2), wherein the substance carrier (2) is configured to be displaced relative to the protective sleeve (4) in order to displace a free end region of the substance (M) into a freely projecting position, and a movement part (5) with a longitudinal slot (6, 6'), in which the substance carrier (2) is guided with a peg (7) engaging into the longitudinal slot (6, 6'), such that the substance carrier (2) can be moved between a retracted position and an extended position, wherein the longitudinal slot (6, 6') has a retaining portion (9) assigned to the extended position, wherein a central longitudinal axis (y) of said retaining portion extends at an angle to a central longitudinal axis (z) of a movement portion (8) of the longitudinal slot (6, 6'), wherein friction cams (24) are formed on the substance carrier (2) and in frictional contact with the inner surface (29) of the movement part (5) during the displacement of the substance carrier (2), wherein the friction cams (24) are designed non-circular with a longer dimension (a) and a shorter dimension (b), and wherein the longer dimension (a) essentially is realized in a direction of the movement portion (8), and wherein, in a view of an outer edge (25) of the friction cam (24) from radially outside, the greatest dimension in the transverse direction is realized eccentric to the greatest dimension in the longitudinal direction.

3. The device according to claim 1, wherein the retaining portion (9) has a catch projection (31), which is configured to be overrun by the peg (7), in order to retain the substance carrier (2) in the extended position.

4. The device according to claim 1, wherein two opposing longitudinal slots (6, 6') are formed.

5. The device according to claim 4, wherein an overrunnable catch projection (31) is formed in the respective retaining portion (9) of both longitudinal slots (6, 6').

6. The device according to claim 4, wherein two pegs (7) are provided for respectively engaging into one of the longitudinal slots (6, 6').

7. The device according to claim 6, wherein a control groove (26) is formed in the counter-retaining cylinder (3) for each peg (7).

8. The device according to claim 7, wherein both control grooves (26) have an inclined surface (27) assigned to the extended position.

9. The device according to claim 2, wherein, in a standing position of the device (1), in which its longitudinal axis (x) essentially is oriented vertically and the opening for displacing the substance (M) outward in a sliding manner is directed upward, the greatest dimension in the transverse direction is realized underneath a center of the greatest dimension in the longitudinal direction of the catch projection (31).

10. The device according to claim 2, wherein the outer edge (25) of the friction cam (24) has a drop-shaped contour.

11. The device according to claim 1, wherein the obtuse angle is between 100 and 170 degrees.

* * * * *